US012467707B2

(12) United States Patent
Painter

(10) Patent No.: US 12,467,707 B2
(45) Date of Patent: Nov. 11, 2025

(54) FIREARM BARREL FOR LEVER ACTION FIREARM

(71) Applicant: Blackstone Firearms, LLC, Delavan, WI (US)

(72) Inventor: Aaron E. Painter, Delavan, WI (US)

(73) Assignee: Blackstone Firearms, LLC

( * ) Notice: Subject to any disclaimer, the term of this patent is extended or adjusted under 35 U.S.C. 154(b) by 0 days.

(21) Appl. No.: 18/583,620

(22) Filed: Feb. 21, 2024

(65) Prior Publication Data

US 2025/0264288 A1 Aug. 21, 2025

(51) Int. Cl.
*F41A 21/04* (2006.01)

(52) U.S. Cl.
CPC ..... *F41A 21/04* (2013.01)

(58) Field of Classification Search
CPC ..... F41A 21/04
USPC ..... 42/76.02
See application file for complete search history.

(56) References Cited

U.S. PATENT DOCUMENTS

| | | | | |
|---|---|---|---|---|
| 5,600,912 | A * | 2/1997 | Smith | F41A 21/02 42/76.01 |
| 2002/0078616 | A1* | 6/2002 | Perry | F41A 21/04 42/76.01 |
| 2005/0108916 | A1* | 5/2005 | Keeney | F41A 21/02 42/76.02 |
| 2018/0202736 | A1* | 7/2018 | Teetzel | F41A 11/02 |
| 2018/0238653 | A1* | 8/2018 | Kunsky | F41A 21/30 |
| 2024/0133649 | A1* | 4/2024 | Boretto | F41A 21/04 |
| 2024/0240896 | A1* | 7/2024 | Ricci | F41A 21/30 |

* cited by examiner

*Primary Examiner* — Samir Abdosh

(57) ABSTRACT

A firearm barrel for a lever action firearm. The firearm barrel has an inner barrel, and outer barrel, and a muzzle keeper. The firearm barrel may also include a gas bushing.

10 Claims, 13 Drawing Sheets

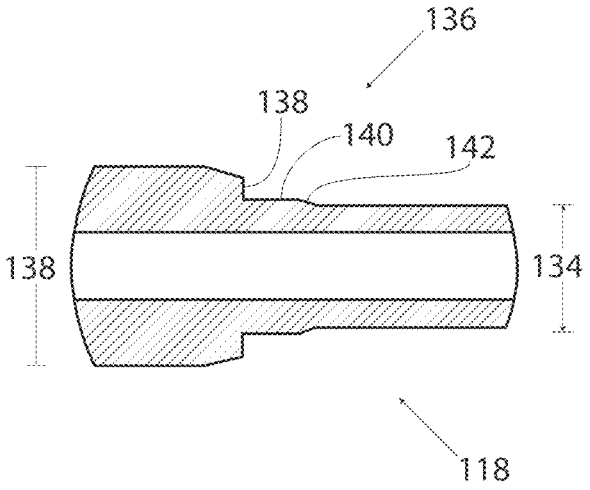
Fig. 16
Fig. 17
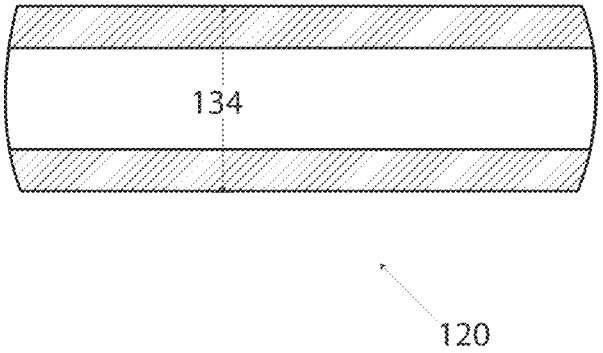
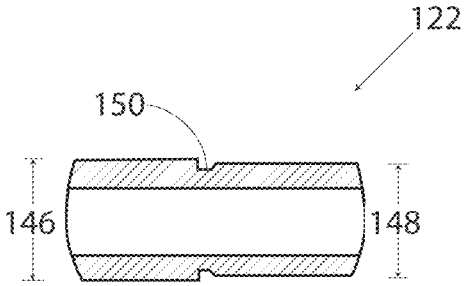
Fig. 18

FIREARM BARREL FOR LEVER ACTION FIREARM

BACKGROUND OF THE INVENTION

The present invention relates to barrels used in firearms, and, more particularly to a lever action firearm. Lever action firearms are typically rifles, but could also be shotguns and even pistols.

Lever action firearms generally have a cocking handle or bolt handle located around the trigger guard. The cocking handle is manually operated to move a bolt of the firearm to feed or remove cartridges in and out of the firearm chamber, and cock the firing mechanism to allow the firearm to be fired.

As with firearms in general, one of the areas of issue or concerns with lever action firearms is the accuracy of the firearm and the ability to handle the firearm after being fired. The barrel of the firearm tends to heat up after continuous use and the accuracy may diminish, as well. Thus, a need exists for a lever action firearm barrel with improved accuracy and ease of handling.

SUMMARY OF THE INVENTION

The present invention is directed towards a firearm barrel for a lever action firearm. The barrel generally comprises an inner barrel and an outer sleeve. The inner barrel has a support area for receiving the outer sleeve. A muzzle keeper is attached to the end of the outer barrel.

BRIEF DESCRIPTION OF DRAWINGS

FIG. 16 is a close-up view of the inner barrel of the area of line 16-16 of FIG. 14.

FIG. 17 is a close-up view of the inner barrel of the area of line 17-17 of FIG. 14.

FIG. 18 is a close-up view of the inner barrel of the area of line 15-15 of FIG. 14.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
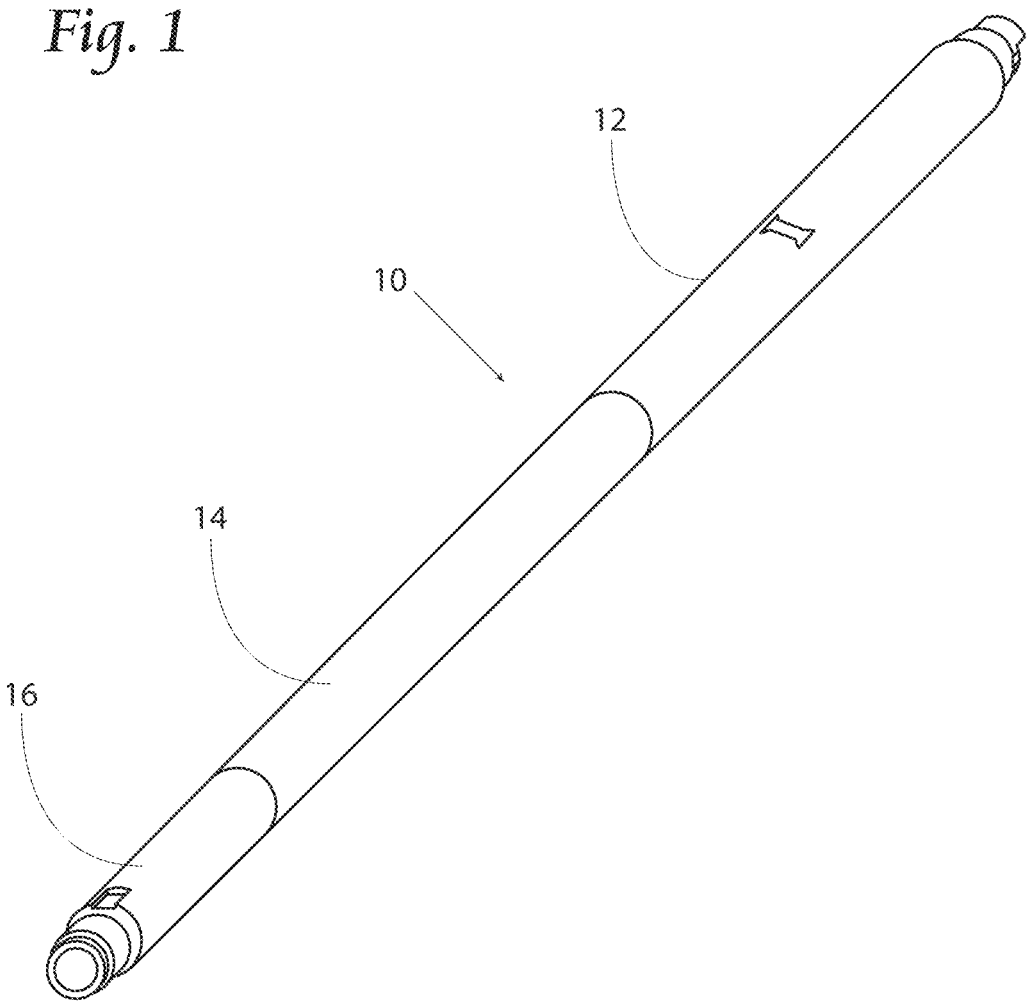
FIG. 1 is a perspective view of an inner barrel for a firearm barrel according to the present invention.

FIG. 1 is a perspective view of a firearm barrel 10 according to the present invention. The firearm barrel 10 is designed specifically for use with a lever action firearm. The barrel 10 generally comprises an inner barrel 12 an outer sleeve 14 and a muzzle keeper 16. The inner barrel 12 is preferably machined from a metal material such as steel, e.g. stainless steel. As will be appreciated further in the discussion below, the arrangement and materials of the firearm barrel 10 provide an advantageous device compared to prior art firearms.

Figure 2:
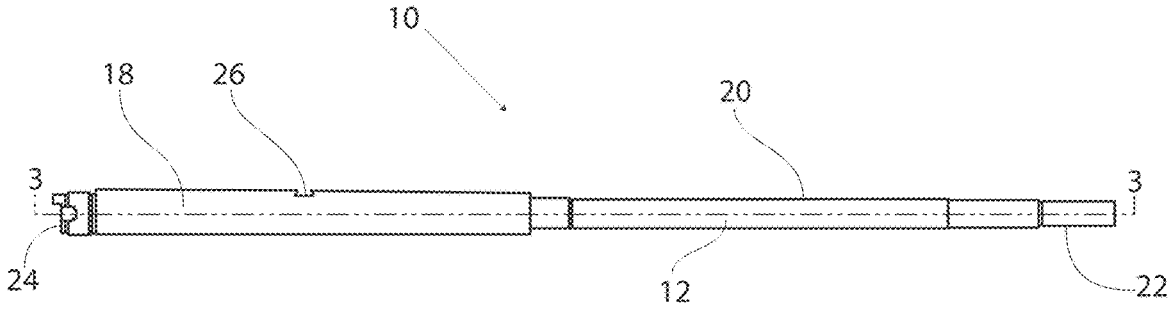
FIG. 2 is a side view of the firearm barrel of FIG. 1.

FIG. 2 shows a side view of the inner barrel 12. The inner barrel 12 has a rear section 18, an intermediate section 20 and a front section 22. The rear section 18 provides an area for the forearm of a firearm (not shown) to be attached to the firearm barrel 10. The intermediate section provides an area for the outer sleeve 14 to be situated, and the front section 22 provides an area for the muzzle keeper 16 to be positioned.

Still referring to FIG. 2, the rear section 18 further comprises an attachment end 24 that allows the barrel 10 to be attached or coupled to the gun's firing chamber (not shown), and the rear section 18 also has an attachment area 26 for a rear site (not shown). The diameter of the rear section 18 is also greater than the diameter of the intermediate section 20 and the front section 22.

Figure 3:
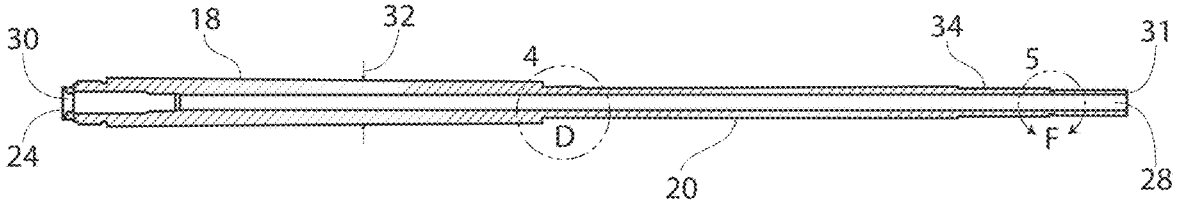
FIG. 3 is a cross-sectional view of the firearm barrel of FIG. 1.
Figure 4:
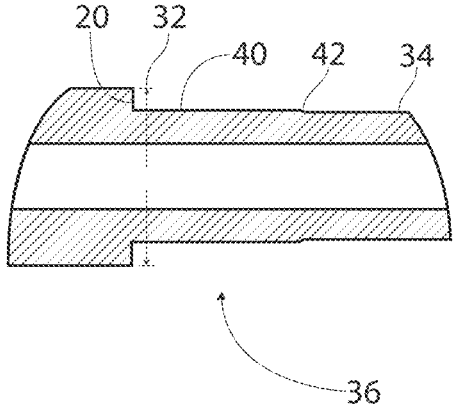
FIG. 4 is close-up view of the firearm barrel taken along line 4-4 of FIG. 3.

FIG. 3 provides a cross-sectional view of the inner barrel 12. The inner barrel 12 comprises an elongated tube 28 having an entrance end 30 and an exit end 31. The inner barrel 12 has a first outer diameter (OD) 32 for the rear section 18, and a second OD 34 for the intermediated section 20. As can be seen more clearly in the close-up view in FIG. 4, the first OD 32 transfers to the second OD 34 by way of a support area 36. The support area 36 comprises an abutment wall 38, which leads down to a support shelf 40 for the outer sleeve 14 to rest upon (see FIG. 10). Preferably the abutment wall 38 and the support shelf 40 form a right angle so that the outer sleeve 14 will tightly abut the inner barrel 12. A tapered section 42 extends from the support shelf 40 to the second OD 34, which will provide for a slight gap 44 (see FIG. 9) when the outer sleeve 14 is assembled onto the inner barrel 12. For example, in a preferred embodiment, the gap 44 may be preferably less than 0.10", and less than 0.005". However, it is understood that the gap 44 would be attributable to an arrangement wherein the outer sleeve is a separate structure than the inner barrel, thereby constituting a gap between the two.

Figure 5:
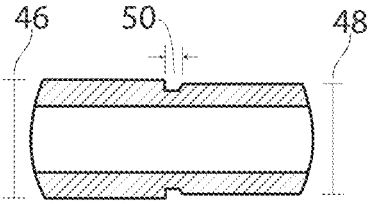
FIG. 5 is a close-up view of the firearm barrel taken along line 5-5 of FIG. 3.

Referring further to FIG. 3, the inner barrel 12 also has a third OD 46 and a fourth OD 48, which both are formed on the front section 22 to accommodate the eventual attachment of the muzzle keeper 16. As shown in the close-up view of FIG. 5, the front section 22 transitions from the third OD 46 to the fourth OD by way of a notch 50, which will matingly receive the muzzle keeper 16 for a secure arrangement.

Figure 6:
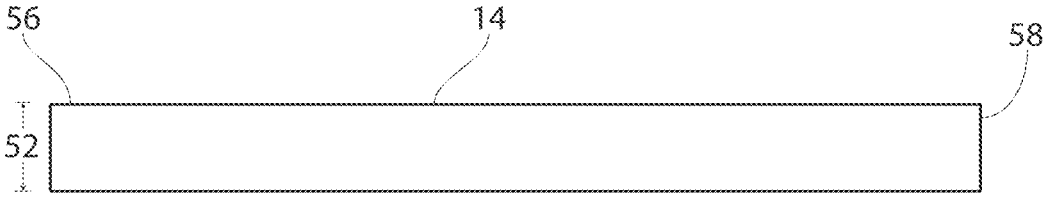
FIG. 6 is a side view of an outer sleeve for a firearm barrel according to the present invention.
Figure 6A:
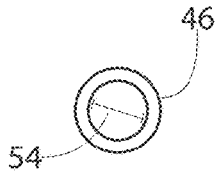
FIG. 6A is a front view of the outer sleeve shown in FIG. 6.

Turning now to FIG. 6 and FIG. 6A, a planar view of the outer sleeve 14 is shown. The outer sleeve 14 has an OD 52 and an inner diameter (ID) 54, as well as a first end 56 and a second end 58. The OD 52 is preferably equal to the first OD 32 of the inner barrel 12, while the ID 54 of the outer sleeve 14 is such that the first end 56 will nest and sit on the support shelf 40. The outer sleeve 14 may be made of any suitable material, but is preferably made of carbon fiber material, which contributes to the capability of the firearm barrel 10 to dissipate heat when fired and allow for quicker and easier handling after firing. Likewise, the slight gap 44 also provides for dissipation of heat, as the outer sleeve 14 is not directly in contact with the inner barrel 12 along the majority, e.g. the intermediate section 18 of the inner barrel 12.

Figure 7:
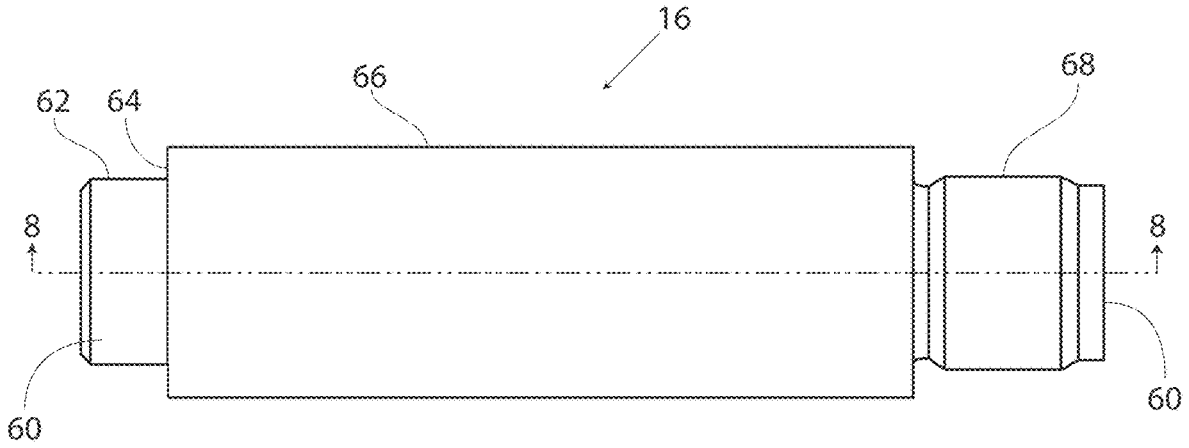
FIG. 7 is a side view of a muzzle keeper used with the present invention.
Figure 7A:
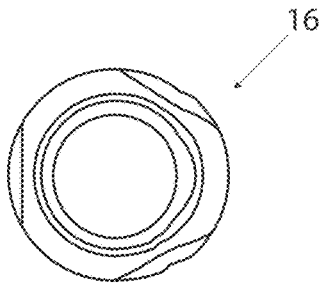
FIG. 7A is a front view of the muzzle keeper of FIG. 7
Figure 8:
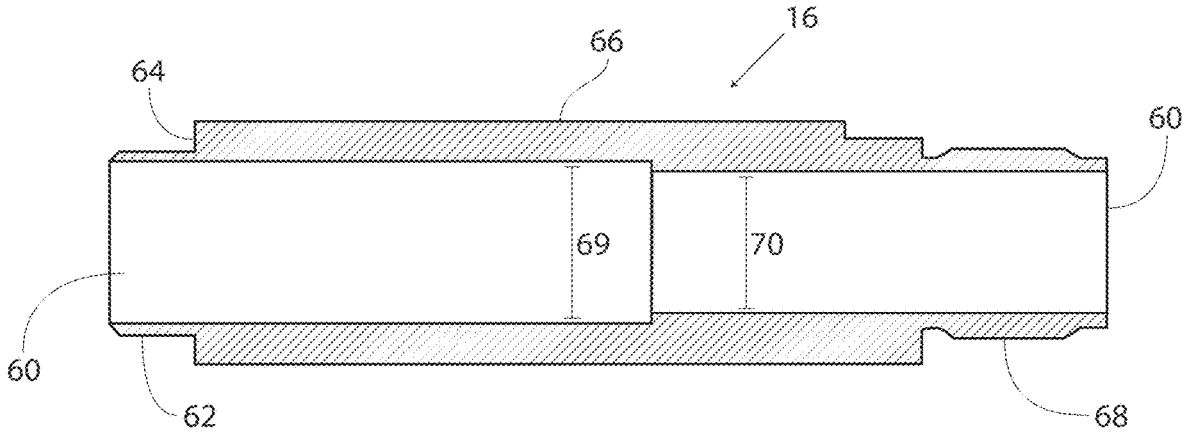
FIG. 8 is a cross-sectional view of the muzzle keeper shown in FIG. 7 taken along the line 8-8 of FIG. 7.

FIG. 7 (planar), FIG. 7A (front view) and FIG. 8 (cross-sectional) depict the muzzle keeper 16. As discussed above, the muzzle keeper 16 will be situated on the front section 22 of the inner barrel 12. The muzzle keeper 16 has a first end 60 that will be inserted over the inner barrel 12 and will provide a front support 62 for the outer sleeve 14. The muzzle keeper 16 also has an abutment wall 64 for the outer sleeve 14 to fit against when the barrel 10 is fully assembled. The muzzle keeper also has a second end 66 that will is located at the exit end 31 of the inner barrel 12 when fully assembled. The muzzle keeper generally has a main body 66 and a muzzle 68 section, with the main body 66 having an OD substantially equal to the OD the outer sleeve 14 and that of the rear section 16 of the inner barrel 12.

Still referring to FIG. 8, the muzzle keeper 16 transitions from a first ID 69 to a second ID 70, with the second ID 70 being less than that of the first ID. This allows for the muzzle keeper 16 to matingly fit within the notch 50, as discussed above.

Figure 9:
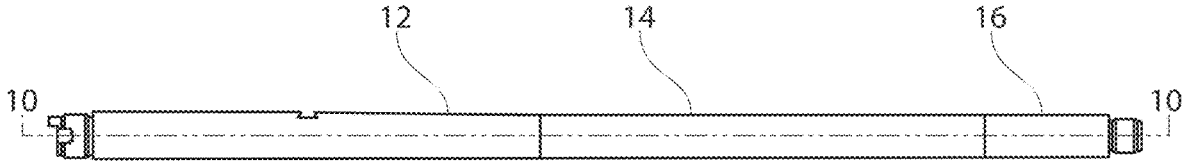
FIG. 9 is planar side view of an assembled firearm barrel according to the present invention.
Figure 10:
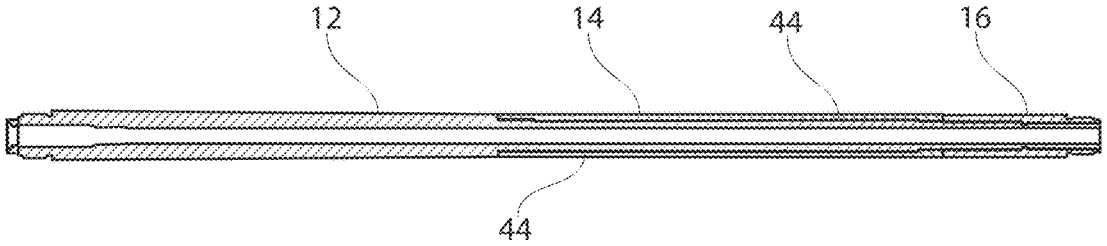
FIG. 10 is a cross-sectional view of the barrel of FIG. 9 taken along the line 10-10.

The resultant assembled barrel 10 is shown in FIGS. 9 and 10. As is appreciated in the planar view in FIG. 10, the three main sections of the firearm barrel 10 fit securely together with one another, with the OD of the barrel consistent along the length of the barrel 10. In the same fashion, the cross-sectional view shown in FIG. 10 demonstrates the improved barrel 10 of the present invention.

Figure 11:
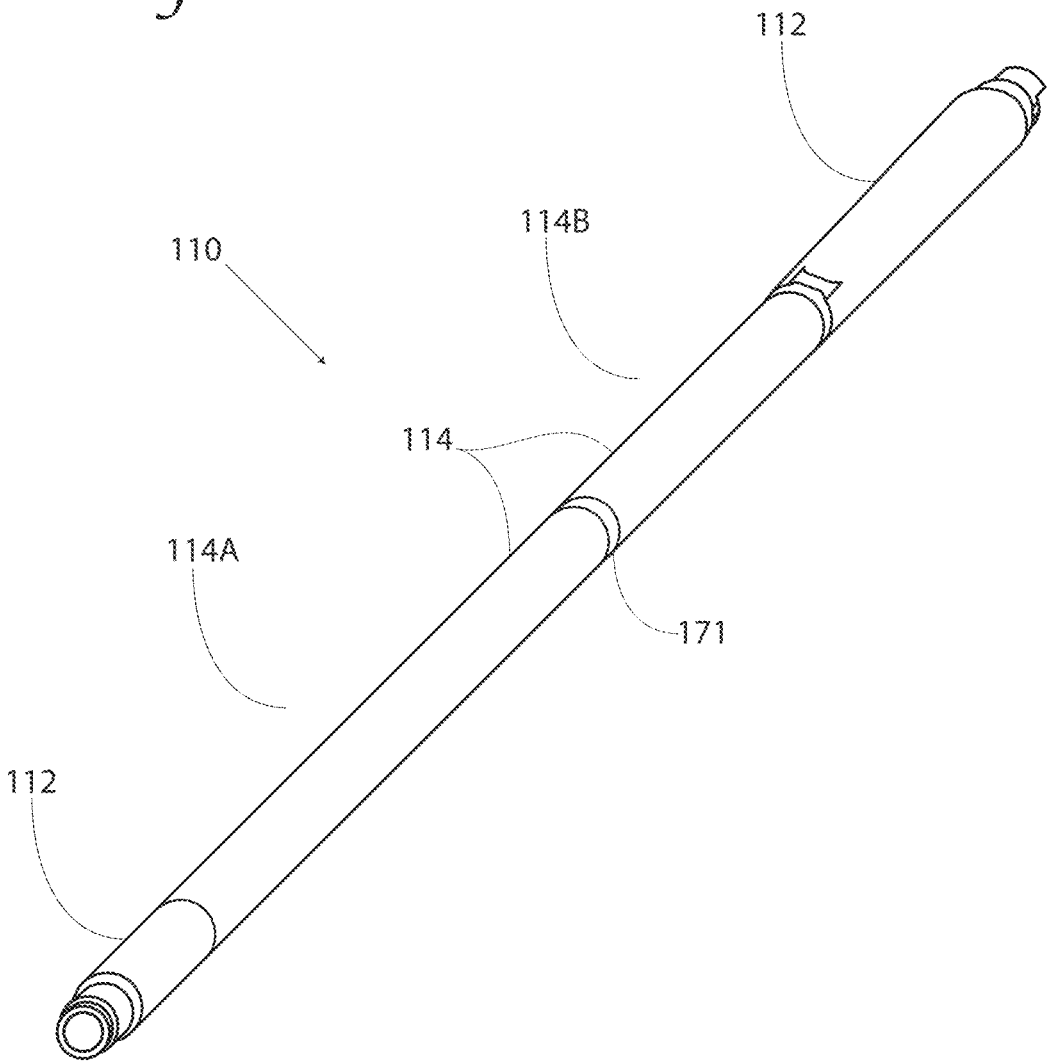
FIG. 11 is a perspective view of an alternate embodiment of a firearm barrel according to the present invention.

FIG. 11 shows a perspective view of a second embodiment of a firearm barrel 110 according to the present invention. The second embodiment 110 is similar to that of the barrel 10, with the second embodiment also having an inner barrel 112, an outer sleeve 114, and a muzzle keeper 116 as described for the barrel 10. The second embodiment 110 differs in that the barrel 110 further incorporates a gas bushing 171, as will be discussed below.

Figure 12:
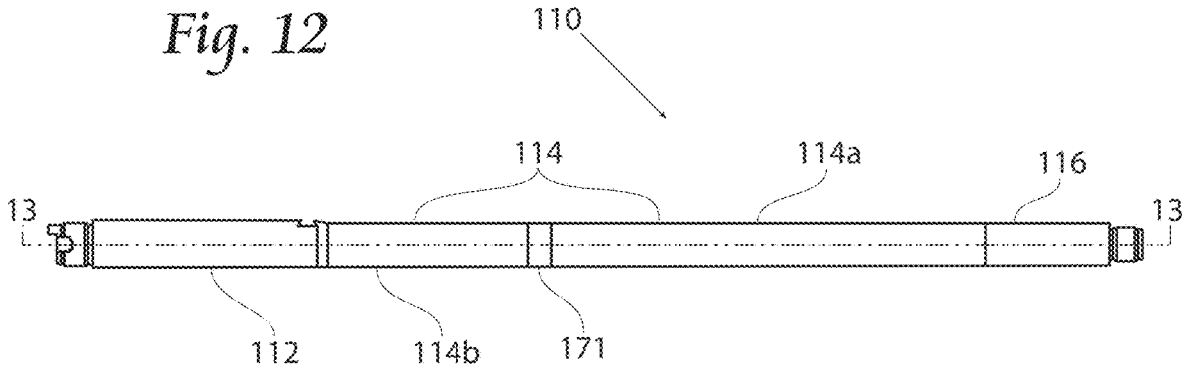
FIG. 12 is a planar side view of the barrel shown in FIG. 11.

FIG. 12 provides a planar view of the firearm barrel 110. As noted, the barrel 110 comprises the inner barrel 112 and the muzzle keeper 116, in the same fashion as similar parts described for the firearm barrel 10, discussed above. The outer sleeve 114 differs from the outer sleeve 14 in that it is comprised of two separate sections, a front section 114*a* and a rear section 114*b*. Preferably, the front section 114*a* is longer than the rear section 114*b*.

Figure 13:
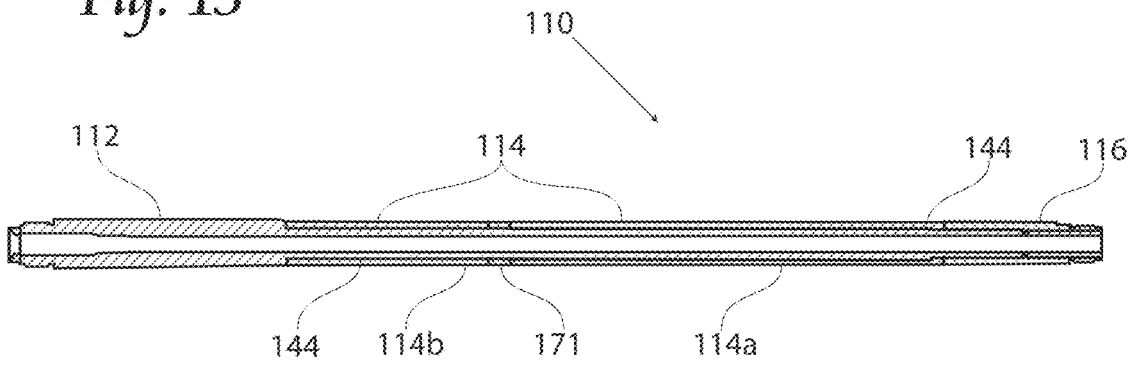
FIG. 13 is a cross-sectional view of the barrel of FIG. 12 taken along the line 13-13 of FIG. 12.

The arrangement of the outer sleeve 114 is further exemplified in the cross-sectional view of firearm barrel 110 shown in FIG. 13. The gas bushing 171 is situated between the front section 114*a* and the rear section 114*b*. As will be appreciated from the discussion below, the gas bushing 171 provides a support for both sections 114*a*, 114*b* to maintain a gap 144 between the outer sleeve 114 and the inner barrel 112.

Figure 14:
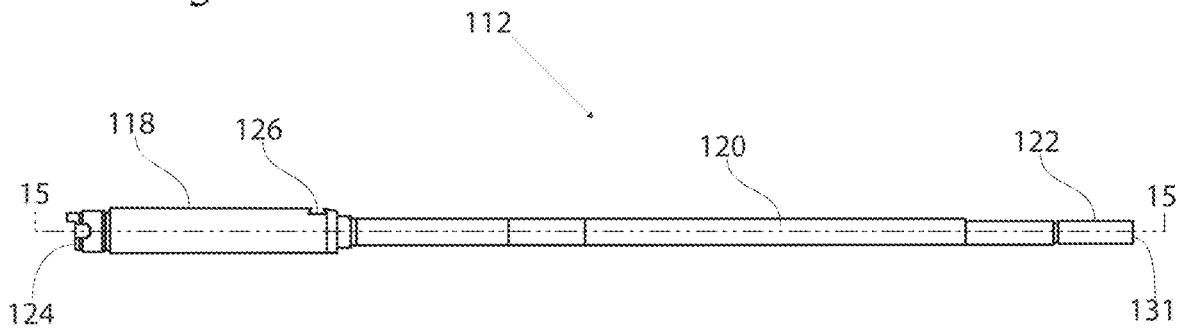
FIG. 14 is side view of an inner barrel used in the embodiment shown in FIG. 11.

FIG. 14 shows a side view of the inner barrel 112. The inner barrel 112 has a rear section 118, and intermediate section 120 and a front section 122. The rear section 118 provides an area for the forearm of a firearm (not shown) to be attached to the firearm barrel 110. The intermediate section 120 provides for an area for the outer sleeve sections 114*a*, 114*b*, as well as the gas bushing 171 to be situated, and the front section 122 provides an area for the muzzle keeper 116 to be positioned.

Still referring to FIG. 14, the rear section 118 further comprises an attachment end 124 that allows the barrel 110 to be attached or coupled to the firearm's firing chamber (not shown), and the rear section 118 also has an attachment area 126 for a rear site (not shown). The outer diameter of the rear section 118 is also greater than the outer diameter of the intermediate section 120 and the front section 122.

Figure 15:
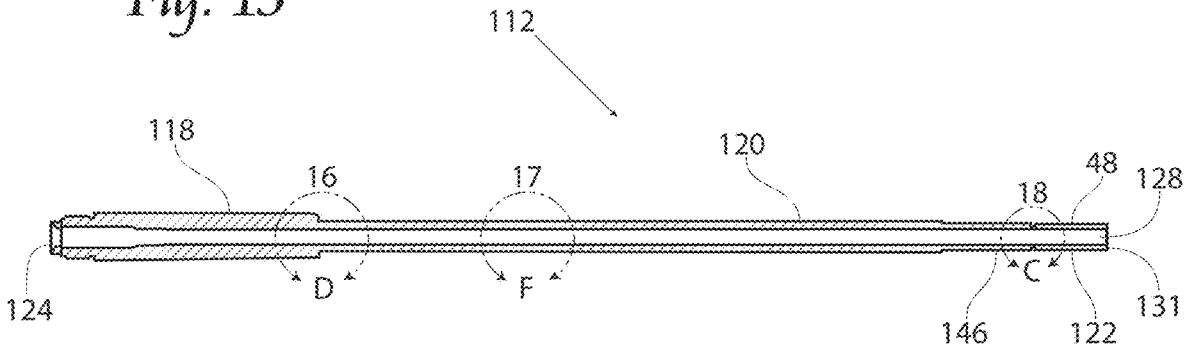
FIG. 15 is a cross-sectional view of the inner barrel of FIG. 14 taken along the line 15-15.

FIG. 15 provides a cross-sectional view of the inner barrel 112. The inner barrel 112 comprises an elongated tube 128 having an entrance end 130 and an exit end 131. The inner barrel 12 has a first outer diameter (OD) 132 for the rear section, and a second OD 134 for the intermediated section 120. As can be seen more clearly in the close-up view in FIG. 16, the first OD 132 transfers to the second OD 134 by way of a support area 136. The support area 136 comprises an abutment wall 138, which leads down to a support shelf 140 for the outer sleeve 114 to rest upon (see FIG. 13). Preferably the abutment wall 138 and the support shelf 140 form a right angle so that the outer sleeve 114 will tightly abut the inner barrel 112 at the abutment wall 138. A tapered section 142 extends from the support shelf 140 to the second OD 134, which will provide for a slight gap 144 (see FIG. 13) when the outer sleeve 114 is assembled onto the inner barrel 112. For example, in a preferred embodiment, the gap 144 may be preferably less than 0.10", and less than 0.005". However, it is understood that the gap 144 would be attributable to an arrangement wherein the outer sleeve is a separate structure than the inner barrel, thereby constituting a gap between the two.

FIG. 17 shows a close-up view of the central area of the outer sleeve 114 that will support the gas bushing 171 (not shown). FIG. 17 demonstrates that the second OD 134 of the outer sleeve 114 is preferably consistent along the length of the intermediate section 120 of the outer sleeve 114.

Referring again to FIG. 15, the inner barrel 112 also has a third OD 146 and a fourth OD 148, which both are formed on the front section 122 to accommodate the eventual attachment of the muzzle keeper 116. As shown in the close-up view of FIG. 18, the front section 122 transitions from the third OD 146 to the fourth OD 148 by way of a notch 150, which will matingly receive the muzzle keeper 16 for a secure arrangement.

Figure 19:
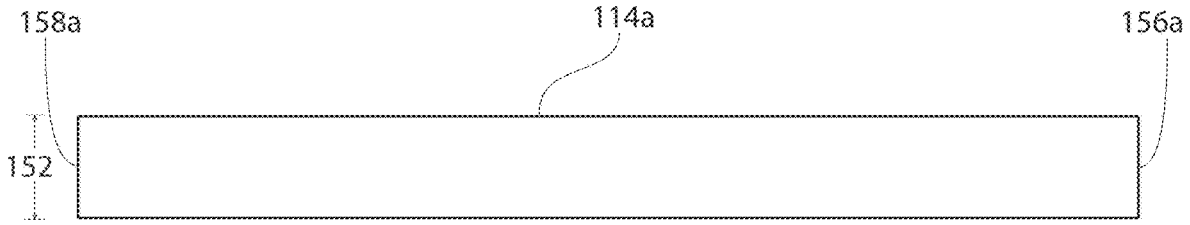
FIG. 19 is planar side view of a rear section of an outer sleeve used in the embodiment of FIG. 11.
Figure 19A:
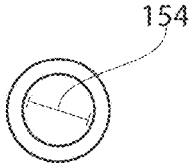
FIG. 19A is a front view of the rear section of FIG. 19.
Figure 20:
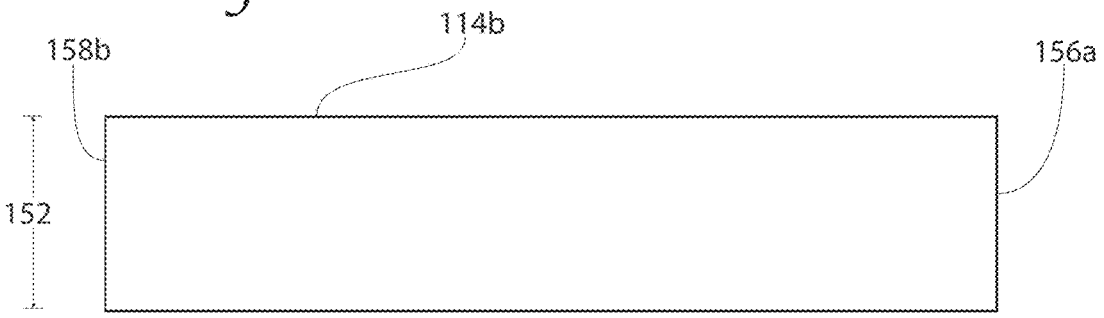
FIG. 20 is a planar side view of a front section of an outer sleeve used in the embodiment of FIG. 11.
Figure 20A:
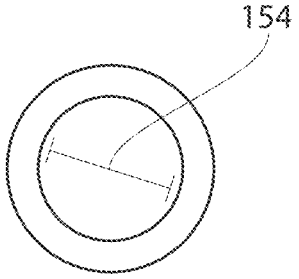
FIG. 20A is a front view of the front section shown in FIG. 20.

Turning now to FIGS. 19 and 20, a planar view of the outer barrel 114 (section 114*a*, FIG. 19, section 114*b*, FIG. 20) is shown. Each section 114*a*, 114*b* of the sleeve 14 has an OD 152 and an inner diameter (ID) 154. Each of the sections 114*a*, 114*b*, has a respective first end 156*a*, 156*b*, and a respective second end 158*a*, 158*b*. The OD 152 is preferably equal to the first OD 132 of the inner barrel 112, while the ID 154 of the outer sleeve 114 is such that the first end 156*a* will nest and sit on the support shelf 140. The outer sleeve 114 may be made of any suitable material, but is preferably made of carbon fiber material, which contributes to the capability of the firearm barrel 110 to dissipate heat when fired and allow for quicker and easier handling after firing. Likewise, the slight gap 144 also provides for dissipation of heat, as the outer sleeve 114 is not directly in contact with the inner barrel 112 along the majority, e.g. the intermediate section 118 of the inner barrel 112.

Figure 21:
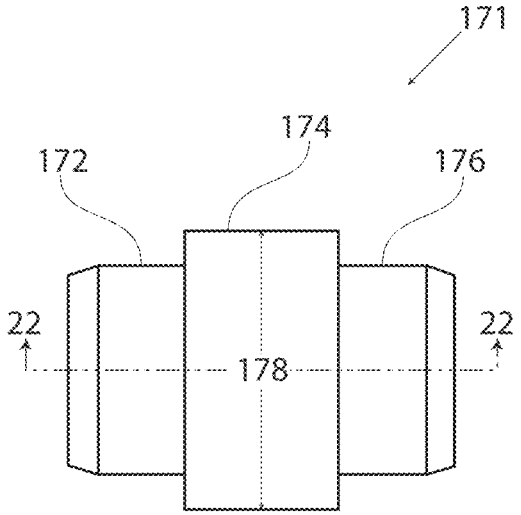
FIG. 21 is a planar side view of a gas bushing used in the embodiment of FIG. 11.
Figure 22:
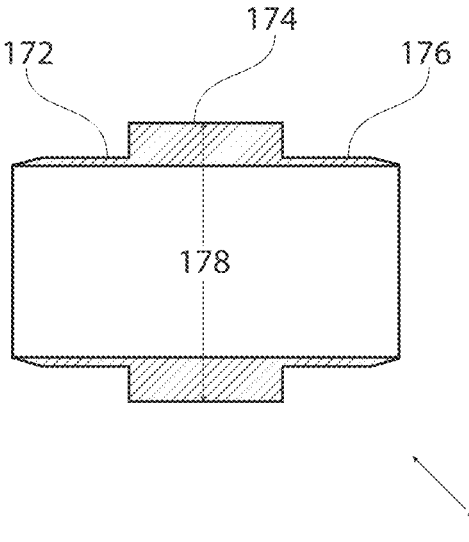
FIG. 22 is cross-sectional view of the gas bushing shown in FIG. 21.

FIG. 21 (planar) and FIG. 22 (cross-sectional) depict the gas bushing 171 used with the firearm barrel 110. The gas bushing 171 generally comprises a front section 172, a central section 174, and a rear section 176. The front section 172 and the rear section 176 have an OD is equal to that of the support shelf 140, to provide support for the outer sleeve sections 114*a* and 114*b*. That is, the rear section 176 will provide support for the second end 158*a*, and the front section 176 will provide support for the front end 156*b*, thereby maintaining the air gap 144 along the intermediate section 118 of the inner barrel 112. The central section 174 has a greater OD 178, essentially equal to the OD of the rear section of the inner barrel.

Figure 23:
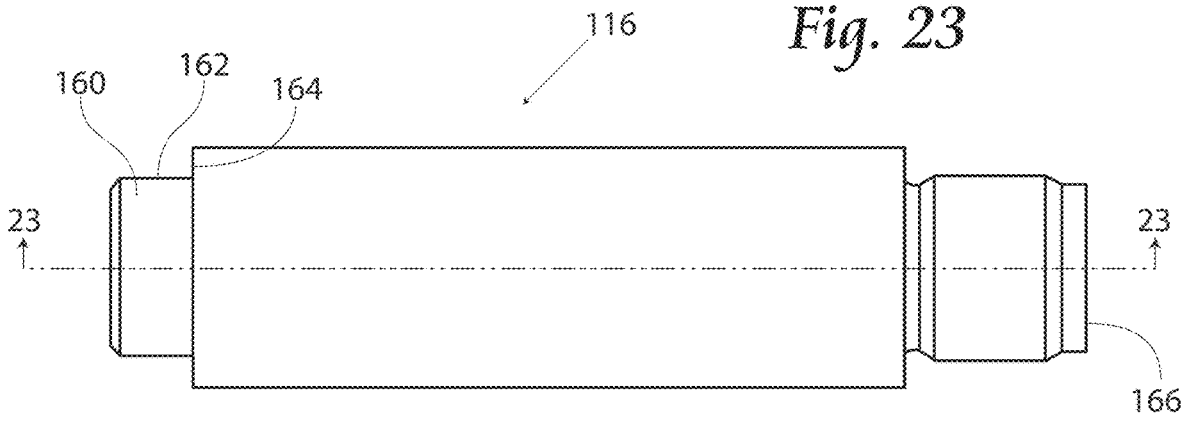
FIG. 23 is planar side view of a muzzle keeper used in the embodiment of FIG. 11.
Figure 23A:
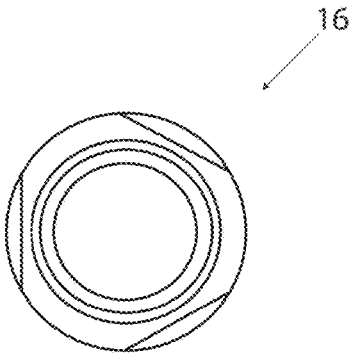
FIG. 23A is a front view of the muzzle keeper of FIG. 23.
Figure 24:
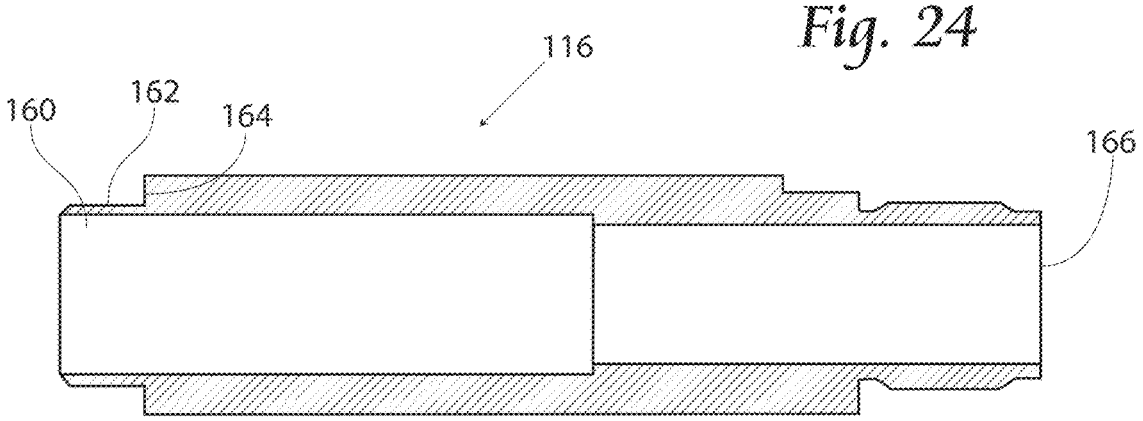
FIG. 24 is a cross-sectional view of the muzzle keeper of FIG. 23.

FIG. 23 (planar), FIG. 23A (front view) and FIG. 24 (cross-sectional) depict the muzzle keeper 116. As discussed above, the muzzle keeper 16 will be situated on the front section 122 of the inner barrel 112. The muzzle keeper 116 has a first end 160 that will be inserted over the inner barrel 112 and will provide a front support 162 for the front end 158*b* of front section 114*a*. The muzzle keeper 116 also has an abutment wall 164 for the front end 158*b* to fit against when the barrel 110 is fully assembled. The abutment wall is preferably forms a right angle with the front support 162. The muzzle keeper 116 also has a second end 166 that will is located at the exit end 131 of the inner barrel 112 when fully assembled. The muzzle keeper generally has a main body 166 and a muzzle 168 section, with the main body 166 having an OD substantially equal to the OD the outer sleeve 114 and that of the rear section 116 of the inner barrel 112.

Still referring to FIG. 23, the muzzle keeper 116 transitions from a first ID 169 to a second ID 170, with the second ID 170 being less than that of the first ID 169. This allows for the muzzle keeper 116 to matingly fit within the notch 150, as discussed above.

The resultant assembled barrel 10 is shown in FIGS. 12 and 13.

Thus, referring again to FIGS. 12 and 13, as with the barrel 10, the three main sections of the firearm barrel 110 fit securely together with one another, with the OD of the barrel consistent along the length of the barrel 110. In the same fashion, the cross-sectional view shown in FIG. 13 demonstrates the improved barrel of the present invention, captured in embodiment 110.

It should be understood that the outer sleeves 14 and 114 are a separate and distinct structure from the inner barrels 12 and 114. That is, while the outer sleeves 14 and 114 can preferably be made of a material such as carbon fiber or other similar mater, the sleeves will still be a solid structure and not a material that is wrapped or adhered onto the outer surface of an inner barrel.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

The invention claimed is:

1. A firearm barrel for a lever action firearm, the firearm barrel comprising:

an inner barrel;

an outer sleeve situated over the inner barrel, said outer sleeve comprising an outer sleeve outer diameter; and a muzzle keeper coupled to the inner barrel, said muzzle keeper comprising a first end portion and a second end portion;

said first end portion of said muzzle keeper comprising a first muzzle keeper outer diameter and a second muzzle keeper outer diameter, said first muzzle keeper outer diameter less than said second muzzle keeper outer diameter;

said muzzle keeper further comprising an abutment wall about said muzzle keeper, said abutment wall having a height comprising a difference between said first muzzle keeper outer diameter less than said second muzzle keeper outer diameter;

said second muzzle keeper outer diameter equal to said outer sleeve outer diameter.

2. The firearm barrel according to claim 1, wherein the inner barrel comprises a rear section, an intermediate section, and a front section, wherein the outer sleeve is situated over the intermediate section of the inner barrel.

3. The firearm barrel according to claim 2, wherein a gap is formed between the outer sleeve and the intermediate section of the inner barrel.

4. The firearm barrel according to claim 3, wherein the outer sleeve is formed of a carbon fiber material.

5. The firearm barrel according to claim 2, wherein the rear section of the inner barrel has an outer diameter (OD) that is substantially the same as an OD of the outer sleeve.

6. The firearm barrel of claim 5, wherein the rear section of the inner barrel further comprises a support area for supporting the outer sleeve.

7. A firearm barrel for a lever action firearm, the firearm barrel comprising:

an inner barrel;

an outer sleeve situated over the inner barrel;

a gas bushing situated over the inner barrel; and a muzzle keeper coupled to the inner barrel, said muzzle keeper comprising a first end portion and a second end portion;

said first end portion of said muzzle keeper comprising a first muzzle keeper outer diameter and a second muzzle keeper outer diameter, said first muzzle keeper outer diameter less than said second muzzle keeper outer diameter;

said muzzle keeper further comprising an abutment wall about said muzzle keeper, said abutment wall having a height comprising a difference between said first muzzle keeper outer diameter less than said second muzzle keeper outer diameter;

said second muzzle keeper outer diameter equal to said outer sleeve outer diameter.

8. The firearm barrel according to claim 7, wherein the outer sleeve further comprises a front section and a rear section, said gas bushing situated between said front section and said rear section of said outer sleeve.

9. The firearm barrel according to claim 7, wherein a gap is formed between the outer sleeve and the inner barrel.

10. The firearm barrel according to claim 9, wherein the outer sleeve is formed a carbon steel material.

* * * * *